United States Patent [19]

Matsuno et al.

[11] Patent Number: 5,027,107

[45] Date of Patent: Jun. 25, 1991

[54] FREQUENCY SENSOR

[75] Inventors: Yasuhiro Matsuno, Yanai; Hajime Terakado, Toshima; Masaru Mochizuki, Nakakoma; Heiji Moroshima, Koufu; Hiroyuki Kamei, Suita, all of Japan

[73] Assignees: Hitachi, Ltd., Tokyo; Hitachi Tokyo Electronics Co., Ltd., Ohme, both of Japan

[21] Appl. No.: 371,776

[22] Filed: Jun. 27, 1989

[30] Foreign Application Priority Data

Jul. 6, 1988 [JP] Japan ..... 63-168098

[51] Int. Cl.[5] ..... G08B 13/14

[52] U.S. Cl. ..... 340/572; 340/825.72; 343/894

[58] Field of Search ..... 340/572, 825.72; 343/894

[56] References Cited

U.S. PATENT DOCUMENTS 4,783,646 11/1988 Matsuzaki ..... 340/572
4,853,703 8/1989 Murakami et al. ..... 343/700 MS

FOREIGN PATENT DOCUMENTS 51-149880 7/1986 Japan .

*Primary Examiner*—Glen R. Swann, III
*Assistant Examiner*—Thomas J. Mullen, Jr.
*Attorney, Agent, or Firm*—Pennie & Edmonds

[57] ABSTRACT

A small-sized thin frequency sensor developed for prevention of theft of an article. The frequency sensor comprises a receiving antenna portion to receive high frequency waves, and a transmitting antenna portion which is shaped into a closed loop with a diode incorporated therein and is disposed linearly to the receiving antenna portion to form an oblong rectangular contour as a whole.

22 Claims, 5 Drawing Sheets

FREQUENCY SENSOR

BACKGROUND OF THE INVENTION

1. Field of the Invention

The present invention relates to a frequency sensor and, more particularly, to a card-shaped or similar frequency sensor contrived to be attached to an article such as a video tape, video disc, compact disc or audio disc for the purpose of preventing theft thereof.

2. Description of the Prior Art:

Regarding the conventional frequency sensors of the type mentioned, there is known an example disclosed in Japanese Patent Laid-open No. 61 (1986)-149880.

For achieving a dimensional reduction in such known frequency sensor, a transmitting antenna pattern is disposed in a U-shaped receiving antenna pattern, and an anode of a multiplier diode is connected to a predetermined portion of the receiving antenna pattern, while a cathode of such diode is connected to a predetermined portion of the transmitting antenna pattern.

The above frequency sensor is considered particularly effective as a type to be suspended from a garment, gem or the like for prevention of theft.

SUMMARY OF THE INVENTION

As a result of a sufficient study of the frequency sensor described above, the present inventor has found that its sensing capability is extremely deteriorated when attached to the surface of a package of a compact disc, video tape or the like.

For example, when the frequency sensor is attached to the surface of a compact disc case, since the disc itself is composed of a single plate of metal (aluminum), radio waves emitted from the sensor are reflected by the compact disc or are absorbed therein, which degrades its sensitivity.

Also, attaching the frequency sensor to the surface of a cassette case or a video tape case causes a similar deterioration of its sensitivity.

Consequently, the frequency sensor sometimes fails to completely perform its function when attached to some article surfaces.

Even if use on the article surface is made possible by increasing the output of the sensor to solve the problems mentioned, there still remains a disadvantage in that due to the large dimensions of the above-described frequency sensor, the printed title or content of the article is concealed and rendered unseen by the card surface of the frequency sensor, particularly when it is attached to the case of any oblong article such as a compact disc or video tape.

In an attempt to eliminate such a disadvantage, the present invention realizes an improved frequency sensor which is capable of completely performing its essential function and allowing attachment to a surface spaced apart from a compact disc, video tape or the like.

It is an object of the present invention to provide a frequency sensor adapted for attachment to the surface of an article.

Another object of the invention is to provide a high-reliability frequency sensor.

A still further object of the invention is to provide a frequency sensor particularly suited for attachment to an oblong article or its surface.

Among the inventions disclosed in the present specification, some typical features will be briefly summarized below.

First, a transmitting antenna portion formed in the shape of a closed loop with a diode incorporated in a part thereof is disposed outside of a receiving antenna portion linearly in the longitudinal direction.

Secondly, the frequency sensor comprises a receiving antenna portion to receive radio waves emitted from a transmitter, means for converting a high frequency voltage induced in the receiving antenna portion into an electric power of a higher frequency equivalent to an integral multiple of the input frequency, and a transmitting antenna portion for radiating the power of such integral-multiple higher frequency.

In the above constitution, the transmitting antenna portion is shaped into a loop, and both the receiving and transmitting antenna portions are disposed positionally serial to each other.

According to the means mentioned, the transmitting antenna portion is positioned outside of the receiving antenna portion linearly in the longitudinal direction, so that it becomes possible to shape the antenna pattern of the frequency sensor into an oblong contour which is suited for attachment or adhesion to an oblong article or its surface, whereby any functional deterioration derived from attachment to the article surface can be minimized while the satisfactory sensitivity is retained with certainty.

BRIEF DESCRIPTION OF THE DRAWINGS

FIG. 3 (*b*) is a sectional view taken along the line X–X' in FIG. 3 (*a*);

FIG. 3 (*c*) is a sectional view of a TAG using the frequency sensor of Embodiment I;

FIG. 8 (*b*) is a sectional view of a semiconductor chip employed in Embodiment III.

DETAILED DESCRIPTION OF THE PREFERRED EMBODIMENTS

Hereinafter the present invention will be described by specific reference to exemplary embodiments thereof, wherein components having like functions are denoted by like numerals or symbols.

[Embodiment I]

Figure 1:
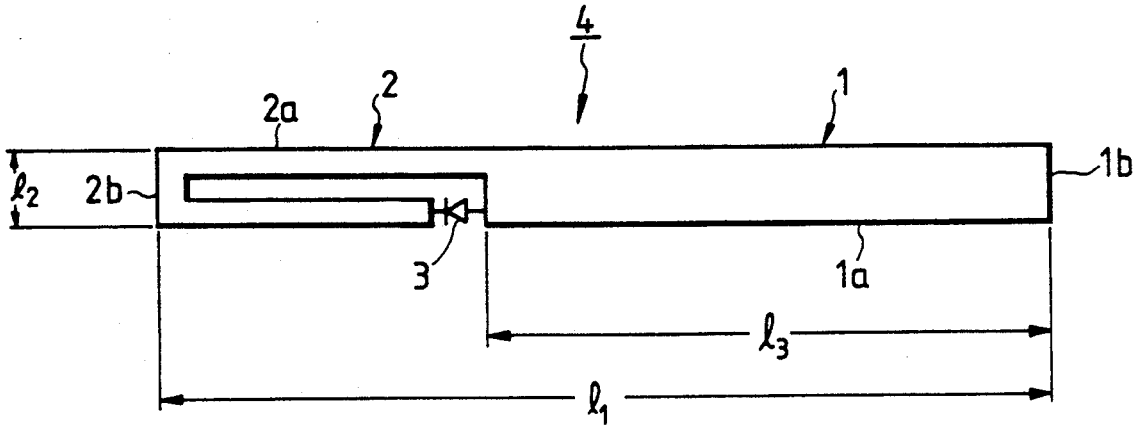
FIG. 1 is a plan view of an antenna pattern in an exemplary frequency sensor representing Embodiment I of the present invention.
Figure 2:
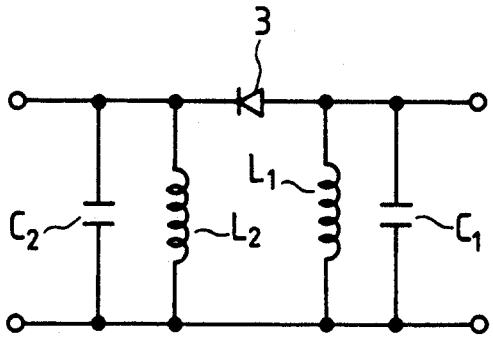
FIG. 2 is a connection diagram of an equivalent circuit of the antenna pattern shown in FIG. 1.

FIG. 1 is a plan view of an antenna pattern in a frequency sensor representing Embodiment I of the present invention, and FIG. 2 is a connection diagram of an equivalent circuit of such antenna pattern.

The antenna pattern 4 in the frequency sensor 5 of Embodiment I comprises a receiving antenna portion 1 and a transmitting antenna portion 2. Although the antenna pattern 4 in this embodiment is composed of copper (Cu), it may also be composed of a film of silver-palladium (Ag-Pd) alloy or aluminum (Al).

The receiving antenna portion 1 is shaped into an oblong parallelogram or a rectangle where the dimensional ratio of its longer side 1*a* and shorter side 1*b* is considerably great. The sensitivity of such receiving antenna portion 1 becomes higher in accordance with an increase of its area.

The transmitting antenna portion 2 is disposed outside of one end of the rectangular receiving antenna portion 1 and is connected thereto linearly in the longitudinal direction. The transmitting antenna portion 2 is also shaped into a rectangle which has a longer side 2*a* extending in the same direction as the longer side 1*a* of the receiving antenna portion 1 and a shorter side 2*b* equal in length to the shorter side 1*b* of the receiving antenna portion 1.

Accordingly, in the frequency sensor of Embodiment I as a whole, its longer side has a total length corresponding to the linear sum of the sides 1*a* and 2*a* while its shorter side has a length of the side 1*b* (or 2*b*), so that the entirety forms an oblong or rectangular plane where the dimensional ratio of the longer side and the shorter side is extremely great.

The whole of the transmitting antenna portion 2 is shaped into a closed loop where a multiplier diode 3 is incorporated in one corner proximate to the receiving antenna portion 1. Therefore the multiplier diode 3 partially constitutes the closed loop of the transmitting antenna portion 2 and is positioned on such antenna loop. Consequently it signifies that the multiplier diode 3 is short-circuited with respect to direct current due to the closed loop of the transmitting antenna portion 2, whereby electrostatic breakdown of the diode 3 can be prevented.

The antenna pattern 4 is so designed that its entire length becomes equal to an integral multiple of $\lambda/4$ (where $\lambda$ is the wavelength), hence causing resonance to such high frequency waves (1.15 GHz) radiated from a detecting apparatus. In Embodiment I, the dimensions are so selected as $l1=56$ mm, $l2=7$ mm and $l3=31$ mm.

The multiplier diode 3 employed in this embodiment consists of a Shottky diode for example.

In the equivalent circuit of FIG. 2, a capacitor C1 and a coil L1 serve as a distributed constant determined by the shape of the receiving antenna portion 1 in FIG. 1; while a capacitor C2 and a coil L2 serve as a distribution constant determined by the shape of the transmitting antenna portion 2. And the reception tuning frequency is determined by a combination of the capacitor C1 and the coil L1; while the transmission tuning frequency is determined by a combination of the capacitor C2 and the coil L2.

Figure 3A:
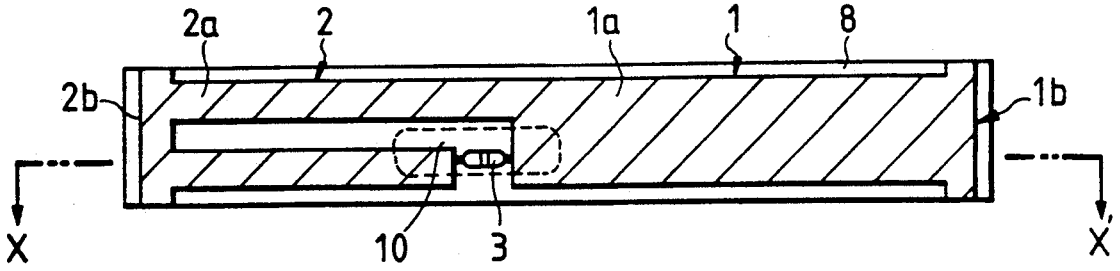
FIG. 3 (*a*) is a sectional view of principal components in a TAG using the frequency sensor of Embodiment I.
Figure 3B:
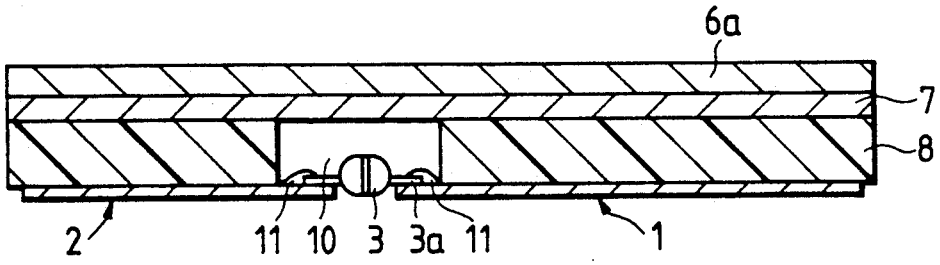
Figure 3C:
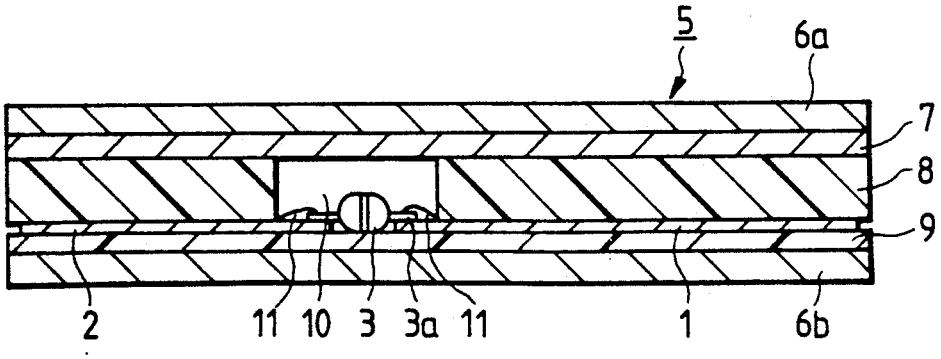

Denoted by 8 in FIG. 3 (*a*) is a spacer which covers the thickness of the diode 3 so as to protect the same. The spacer 8 is composed of polyester thermally sealable and bondable with recility to copper or the like of the conductive antenna pattern 4. There is formed a recess 10 in the spacer 8 for incorporating the diode 3 therein. The spacer 8 has a thickness of, for example, 210 microns or so. Denoted by 3*a* is a lead of the diode 3.

In FIG. 3 (*b*), an upper base 6*a* out of two base members partially constituting the body of the frequency sensor 5 is composed of a sheet of paper having adhesive glue on its one side. It has a thickness of, for example, 100 microns or so.

Denoted by 7 is a laminated seal member for protecting the exposed diode 3 after attachment of the spacer 8. Such seal member 7 is composed of polyester and has a thickness of 80 microns or so.

Also shown is a bonding agent 11 used for fixing the multiplier diode 3 in the antenna pattern 4 (i.e. receiving and transmitting patterns 1 and 2).

In FIG. 3 (*c*), there is shown a base film 9 for the conductive antenna portions 1 and 2, and it is composed of polyphenylene sulfide (hereinafter abbreviated to pps) resin or polyimide resin. With regard to the cost, the pps resin film is less expensive, being substantially half of the polyimide resin film. Denoted by 6*b* is a lower base composed of a sheet of paper similar to the aforementioned upper base.

Now a description will be given on the procedure of assembling the frequency sensor 5.

First a copper foil is applied to the base film 9, and then is processed by etching to form the antenna pattern 4 shown in FIG. 1. Subsequently cream solder 11 is placed at a predetermined position of the antenna pattern 4 and, after a lead 3*a* is joined to the diode 3, the solder 11 is caused to reflow for connecting the diode 3 to the antenna pattern 4. Thereafter the spacer 8 is adhered in such a manner that the diode 3 is positioned exactly in the recess 10. The other side of the spacer 8 not bonded to the antenna pattern 4 is sealed with the laminated member, and then a sheet of paper having adhesive glue thereon is stuck to the reverse surface. Finally the glued assembly is cut into a predetermined size to produce an individual frequency sensor 5.

Figure 4A:
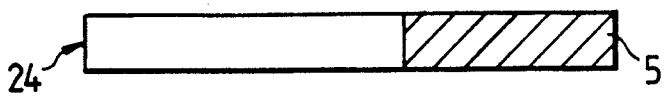
FIGS. 4 (*a*) and 4 (*b*) are a side view and a front view respectively showing a state where the frequency sensor of the present invention is attached to an article.
Figure 4B:
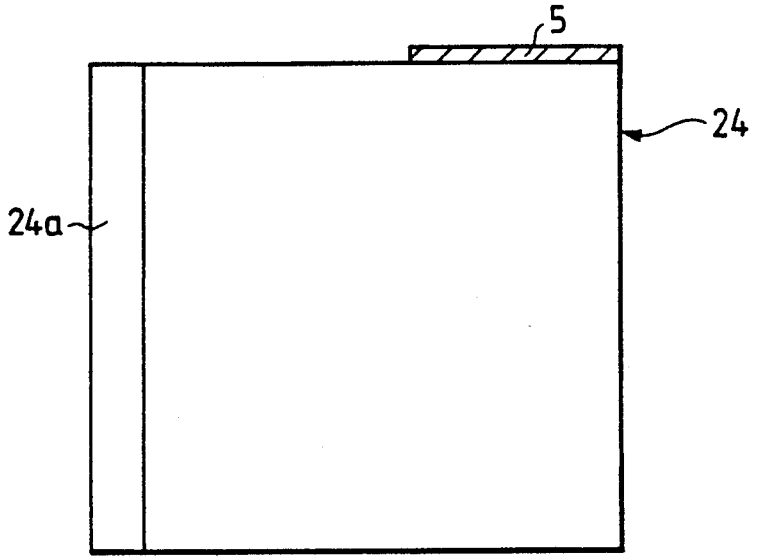

FIGS. 4 (*a*) and 4 (*b*) are a side view and a front view respectively illustrating a state where the frequency sensor 5 is actually attached to an article.

In the illustrations, there are shown a compact disc case 24 and its surface 24*a* where the title or content of such compact disc is printed. If the frequency sensor 5 is attached to the front surface of the compact disc case 24, the radio waves are reflected by or absorbed in the aluminum film deposited on the compact disc to consequently cause attenuation of the sensitivity. Therefore the frequency sensor 5 is attached to the lateral surface of the compact disc case as illustrated. Since the frequency sensor 5 of the present invention is shaped to be rectangular differently from the conventional one, it is attachable with facility to any oblong place such as the lateral surface of a compact disc case in a satisfactory state where its shorter sides never protrude from such lateral surface.

Hereinafter a system for detecting the frequency sensor 5 of the present invention will be described with reference to FIGS. 5 and 6.

Figure 5:
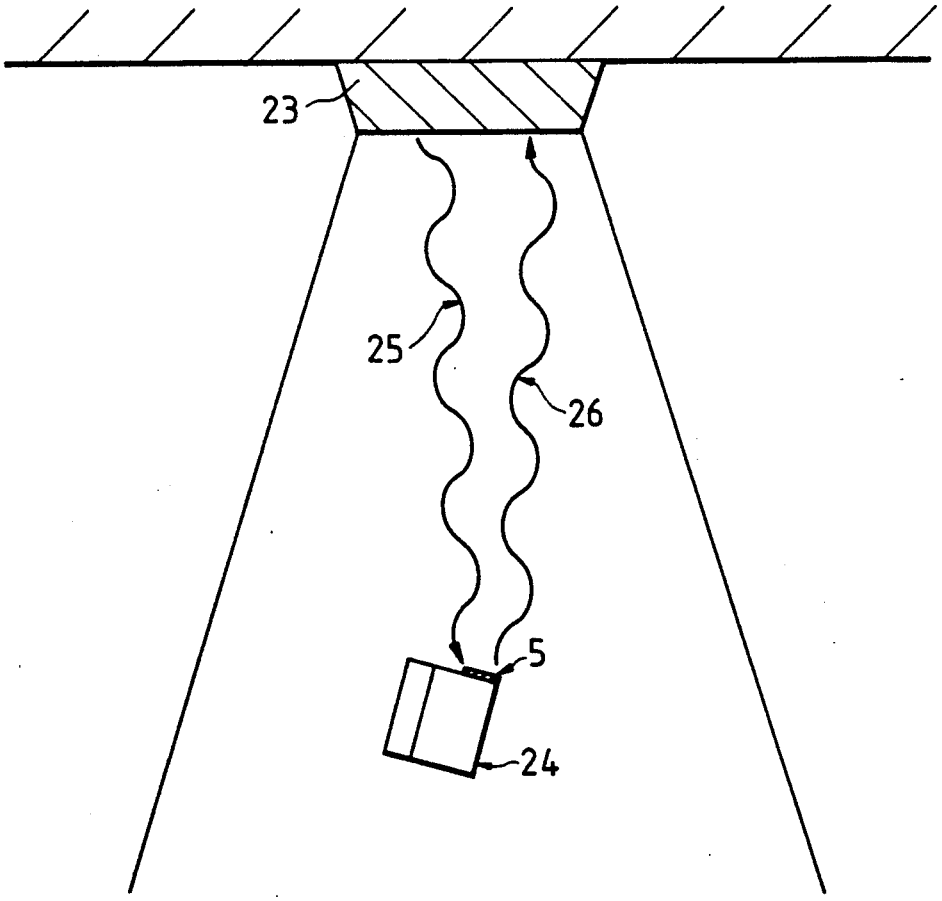
FIG. 5 schematically illustrates how the frequency sensor of the invention is used.

First in FIG. 5, there are shown a detecting apparatus 23, a compact disc case 24, transmitted radio waves (1.15 GHz) 25, and reradiated radio waves (2.30 GHz) 26.

Radio waves 25 of a frequency 1.15 GHz are transmitted from the detecting apparatus 23 to excite the frequency sensor 5, and reflected waves (reradiated waves 26) of a double frequency 2.30 GHz are received therefrom to emit an alarm signal.

Figure 6:
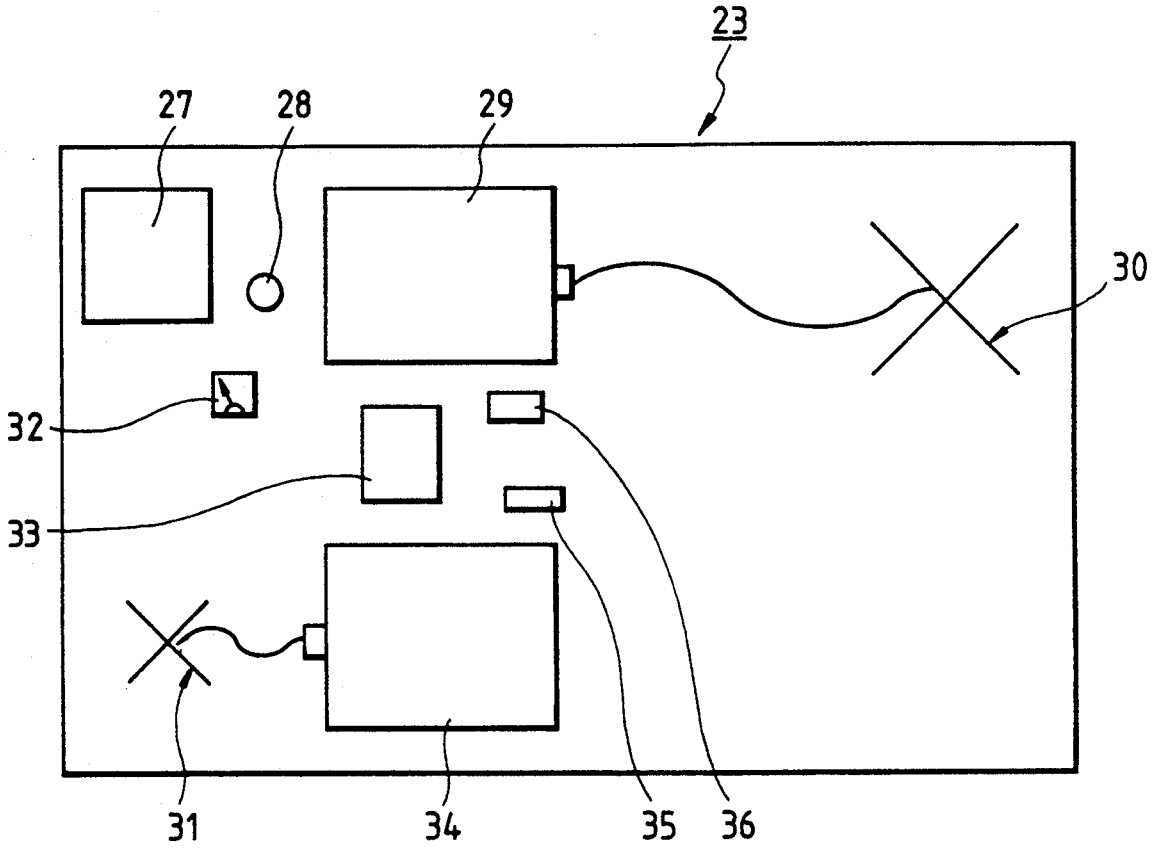
FIG. 6 illustrates the arrangement of component units in a detecting apparatus for the frequency sensor of FIG. 5.

The internal functions of the detecting apparatus 23 are illustrated in FIG. 6, which includes a control panel 27, a buzzer 28, a transmitter 29, a transmitting antenna 30, a receiving antenna 31, a signal strength meter 32, a power supply 33, a receiver 34, a fuse 35, and a line synchronizing transformer 36.

Radio waves of a frequency $f_T$ (1.15 GHz) are radiated from the transmitting antenna 30 in the detecting apparatus 23. If the frequency sensor 5 to be detected is existent within the electric field of the radiated waves, a high frequency current of the frequency $f_T$ is induced in the receiving antenna portion 1 shown in FIG. 1, so that the current thus induced flows in the diode 3 to consequently generate n-order higher frequency waves (where n=2, 3, 4 . . . ) corresponding to integral multiples of the above-described frequency $f_T$, and such higher frequency waves are reradiated from the transmitting antenna portion 2 of the frequency sensor 5.

The detecting apparatus 23 includes a receiver 34 which is tuned to a secondary higher frequency (double of the transmitted wave frequency $f_T$; i.e. 2.30 GHz) having the greatest signal strength out of the entire higher frequency waves reradiated from the frequency sensor 5. And the secondary higher frequency waves received via the antenna 31 of the receiver 34 are outputted as a signal to an alarm device (buzzer 28 in this embodiment), which then emits an alarm signal therefrom.

When the frequency sensor 5 to be detected is not existent within the aforementioned electric field, there occurs no reradiation of the secondary higher frequency waves, so that no signal is inputted to the receiver 34 and therefore no alarm signal is emitted either.

In this embodiment, an 8-bit pulse generator is further included for preventing any malfunction that may otherwise be caused by external radio waves or noises. A pulse train obtained from such pulse generator serves to command either an operation of a halt of the transmitter 29, and a coincidence circuit performs a detection as to whether the reflected signal from the frequency sensor 5 is coincident with such 8-bit pulse train. And the buzzer 28 is driven in response to coincidence with the pulse train.

[Embodiment II]

Figure 7:
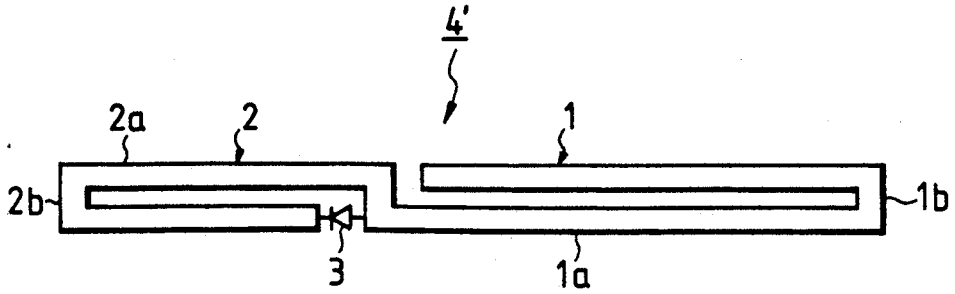
FIG. 7 is a plan view of an antenna pattern in another exemplary frequency sensor representing Embodiment II of the invention.

FIG. 7 shows an antenna pattern 4' of another exemplary frequency sensor which represents Embodiment II of the present invention.

The antenna pattern 4' in the frequency sensor of Embodiment II comprises a receiving antenna portion 1 and a transmitting antenna portion 2. The receiving antenna portion 1 is shaped into an oblong parallelogram or a substantially U-shaped rectangle where the dimensional ratio of its longer side 1*a* and shorter side 1*b* is considerably great.

The transmitting antenna portion 2 is disposed outside of one end of the U-shaped receiving antenna portion 1 and is connected thereto linearly in the longitudinal direction. And similarly to Embodiment I, the transmitting antenna portion 2 is also shaped into a rectangle which has a longer side 2*a* extending in the same direction as the longer side 1*a* of the receiving antenna portion 1 and a shorter side 2*b* equal in length to the shorter side 1*b* of the receiving antenna portion 1.

Accordingly, in the frequency sensor of Embodiment II as a whole, its longer side has a total length corresponding to the linear sum of the sides 1*a* and 2*a* while its shorter side has a length of the side 1*b* (or 2*b*), so that the entirety forms an oblong or rectangular plane where the dimensional ratio of the longer side and the shorter side is extremely great.

The antenna pattern 4' in Embodiment II is set to constitute a frequency sensor in the same manner as in Embodiment I mentioned above.

Also in the frequency sensor of Embodiment II employing the antenna pattern 4', the frequency attenuation is minimized in the use on an article surface, and attachment thereto is achievable with facility. Furthermore, since a multiplier diode 3 incorporated in the closed loop of the transmitting antenna portion 2 is short-circuited with respect to direct current, there never occurs electrostatic breakdown and a remarkable advantage is attainable particularly in the attachment to any rectangular article or its oblong surface.

[Embodiment III]

Figure 8A:
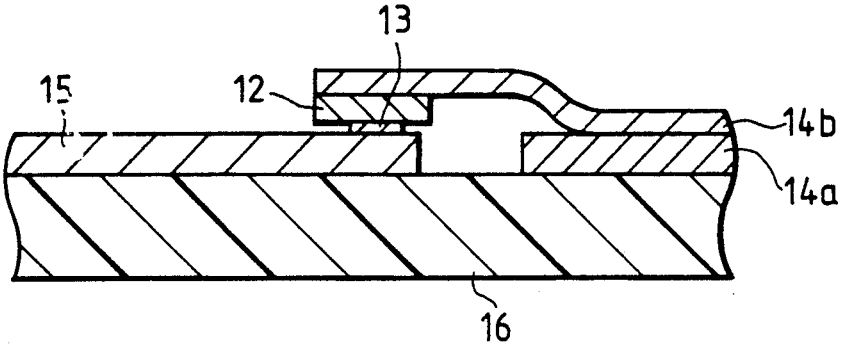
FIG. 8 (*a*) is a sectional view of principal components in a further exemplary frequency sensor representing Embodiment III of the invention.
Figure 8B:
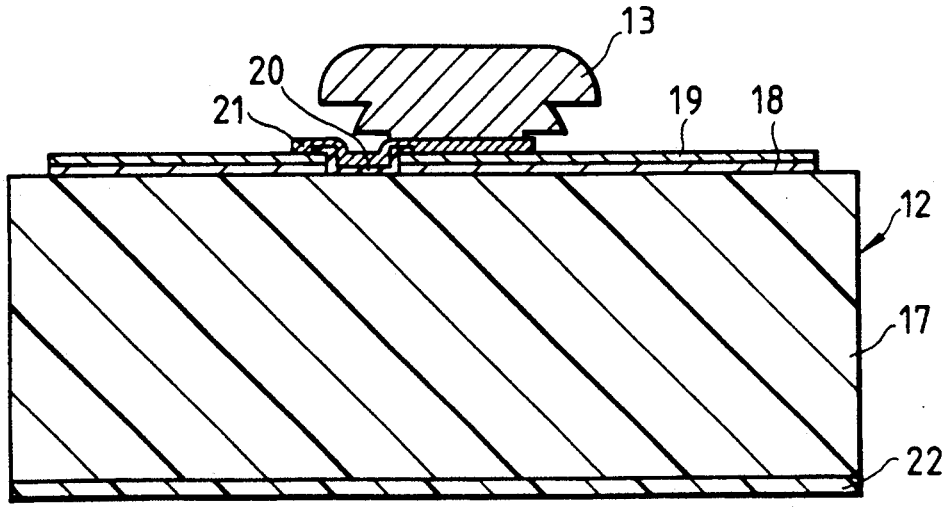

FIG. 8 shows a further exemplary frequency sensor representing Embodiment III of the present invention.

FIG. 8 (*a*) is a sectional view illustrating principal components of such frequency sensor, wherein a diode pellet is employed in place of the multiplier diode 3 connected to the aforementioned antenna pattern 4 in Embodiment I.

There are included a Schottky diode pellet 12, a bump electrode 13 comprised of solder, a receiving antenna lead 14*a*, a transmitting antenna lead 14*b*, a transmitting antenna portion 15, and an attachment base plate 16 comprised of plastic or polyester material.

In the frequency sensor, an antenna pattern 4 is formed on the attachment base plate 16 in the same manner as in Embodiment I. The bump electrode 13 serving as the cathode of the diode pellet 12 is connected to the transmitting antenna portion 15, and the anode thereof is connected to the receiving antenna lead 15*b*, respectively. The diode pellet 12 is interposed and held between the fore end of the transmitting antenna portion 15 and that of the receiving antenna lead 14*b*. Thereafter, upper and lower base sheets each composed of a laminated member or paper are stuck in the same manner as in Embodiment I to produce a desired frequency sensor.

FIG. 8 (*b*) illustrates the details of the diode pellet 12. An epitaxial layer of n-type silicon or the like is formed on a singlecrystal silicon substrate 17 to obtain a semiconductor region by introducing an n-type impurity into the substrate 17, and an insulator film 18 of silicon dioxide $SiO_2$ or the like is formed thereon by thermal oxidation or similar process. Thereafter a PSG film 19 is formed by chemical vapor deposition (CVD), and the semiconductor region is partially removed by etching. A tungsten (W) film 20 and a chromium-silver (Cr-Ag) film 21 are provided in the removed parts of the semiconductor region, and a Schottky joint is formed in the interface between the tungsten film 20 and the substrate 17. Furthermore, the bump electrode 13 serving as a cathode is formed on the chromium-silver film 21.

Meanwhile, a gold-antimony-silver (Au-Sb-Ag) film 22 serving as an anode is formed on the reverse surface of the substrate 17 where the bump electrode 13 is not existent.

Thus, the use of a semiconductor chip in place of the multiplier diode renders the frequency sensor dimensionally thinner than in the foregoing examples of using a diode.

Although the present invention has been described above specifically with reference to some examples, it is to be understood that this invention is not limited to the aforementioned embodiments alone, and a variety of changes and modifications may be contrived within a scope not departing from the spirit thereof.

For example, the dimensional ratio of the longer side and the shorter side of the rectangular frequency sensor is not restricted to that defined in any of Embodiments I, II and III.

Also the shape of the receiving antenna portion 1 is not limited to that described in connection with Embodiment I or II, and it may be some other adequate oblong one as well.

Furthermore, the two antenna portions 1 and 2 may be composed of any suitable material different from that mentioned with regard to Embodiment I.

In addition, the multiplier diode 3 may consist of any proper one other than the aforementioned Schottky type.

The description given hereinabove is concerned with exemplary applications of the present invention to attachment of the frequency sensor to a video tape, video disc, compact disc, audio disc or a case thereof included in the background art. However, the field of utilization is not limited to the above examples alone, and the invention is further applicable to attachment to the surface of some other article or to a different mode of use, such as suspension.

Thus, the frequency sensor of the present invention comprises a receiving antenna portion and a transmitting antenna portion shaped into a closed loop with a diode incorporated therein and disposed outside of the receiving antenna portion linearly in the longitudinal direction, so that the frequency attenuation derived from attachment to an article surface can be minimized to consequently prevent deterioration of the sensitivity, hence realizing satisfactory attachment to the surface.

According to the experimental results confirmed by the present inventor, the frequency attenuation caused in the conventional frequency sensor due to attachment to the surface of a compact disc case is in a range of −10 to −20 dB; whereas the attenuation caused in the present invention under the same condition of use is reduced to −5 dB or so, and no deterioration of the sensitivity is observed to eventually attain certain effect in prevention of theft.

There is achievable another advantageous effect that, since the frequency sensor is rendered oblong in its longitudinal direction, it is attachable with facility to any oblong surface or article having a narrow lateral surface such as a case for a compact disc, video tape or the like. And there never occurs a trouble that characters and so forth printed on the surface are concealed and unseen.

Furthermore, as the transmitting antenna portion is shaped into a closed loop pattern with a diode incorporated therein, the diode is short-circuited with respect to direct current to be eventually kept free from electrostatic breakdown.

In addition, the reliability of the frequency sensor itself can be further enhanced.

What is claimed is:

1. A frequency sensor comprising:

a receiving antenna portion for receiving radio waves;

a transmitting antenna portion for radiating radio waves; and a diode connected between said receiving and transmitting antenna portion, said diode serving to convert a high frequency signal induced in said receiving antenna portion into a signal of a higher frequency equivalent to an integral multiple of an input frequency, and supplying the converted signal to said transmitting antenna portion;

wherein said transmitting antenna portion is shaped into a closed loop and is disposed outside of said receiving antenna portion so as to arrange said transmitting and receiving antenna portions linearly.

2. A frequency sensor according to claim 1, wherein said diode is incorporated in said closed loop, and an anode of said diode is connected to said receiving antenna portion while a cathode thereof is connected to said transmitting antenna portion respectively.

3. A frequency sensor according to claim 1, wherein said receiving antenna portion comprises a thin plate, said thin plate being composed substantially of copper.

4. A frequency sensor according to claim 1, wherein said receiving antenna portion comprises a substantially U-shaped oblong thin plate.

5. A frequency sensor according to claim 4, wherein said thin plate is composed substantially of copper.

6. A frequency sensor according to claim 1, wherein said diode is a multiplier diode.

7. A frequency sensor according to claim 1, wherein said diode comprises a semiconductor pellet.

8. A frequency sensor according to claim 1, wherein said transmitting antenna portion is formed into a substantially U-shaped loop having a longer side and a shorter side.

9. A frequency sensor comprising:

a rectangular receiving antenna portion having a longer side and a shorter side;

a substantially U-shaped rectangular transmitting antenna portion having a longer side and a shorter side; and a diode connected between said receiving and transmitting antenna portions;

wherein said longer sides of said receiving and transmitting antenna portions are disposed linearly so as to arrange said receiving and transmitting antenna portions linearly in direction of said longer sides of receiving and transmitting antenna portions, and the shorter side of said receiving antenna portion is equal in length to the shorter side of said transmitting antenna portion.

10. A frequency sensor according to claim 9, wherein each of said receiving and transmitting antenna portions comprises a thin copper plate.

11. A frequency sensor according to claim 9, wherein said receiving antenna portion is shaped substantially into U.

12. A frequency sensor according to claim 9, wherein said diode is a multiplier diode.

13. A frequency sensor according to claim 9, wherein said diode comprises a semiconductor pellet.

14. A frequency sensor comprising:

a conductive antenna pattern consisting of a receiving antenna portion and a transmitting antenna portion;

a diode connected between said receiving and transmitting antenna portions;

a base film for attaching said antenna pattern;

a spacer adhered onto said conductive antenna pattern;

a seal member adhered onto said spacer so as to protect said diode; and upper and lower base sheets so adhered as to hold therein said conductive antenna pattern, diode, base film, spacer and seal member;

wherein said transmitting antenna portion is shaped into a closed loop with said diode incorporated therein, and is disposed outside of said receiving antenna portion so as to arrange said transmitting and receiving antenna portions linearly.

15. A frequency sensor according to claim 14, wherein said receiving antenna portion is shaped substantially into U.

16. A frequency sensor according to claim 14, wherein said transmitting antenna portion is shaped substantially into U.

17. A frequency sensor according to claim 14, wherein said diode is a multiplier diode.

18. A frequency sensor according to claim 14, wherein said diode comprises of a semiconductor pellet.

19. A frequency sensor according to claim 14, wherein said conductive antenna pattern comprises a thin copper plate.

20. A frequency sensor according to claim 14, wherein said base film is composed substantially of polyphenylene sulfide resin.

21. A frequency sensor according to claim 14, wherein said spacer and seal member are composed substantially of polyester.

22. A frequency sensor according to claim 14, wherein said upper and lower base sheets are composed substantially of paper.

* * * * *